US006794771B2

(12) United States Patent
Orloff

(10) Patent No.: US 6,794,771 B2
(45) Date of Patent: Sep. 21, 2004

(54) FAULT-TOLERANT MULTI-POINT FLAME SENSE CIRCUIT

(75) Inventor: Brian L. Orloff, Plainfield, IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 194 days.

(21) Appl. No.: 10/175,965

(22) Filed: Jun. 20, 2002

(65) Prior Publication Data

US 2003/0234582 A1 Dec. 25, 2003

(51) Int. Cl.[7] ..... H01H 35/00; F23Q 9/08
(52) U.S. Cl. ..... 307/117; 431/18; 431/42
(58) Field of Search ..... 307/117; 431/18, 431/42, 59, 66, 81

(56) References Cited

U.S. PATENT DOCUMENTS 5,577,905 A 11/1996 Momber et al. ..... 431/66
5,722,822 A * 3/1998 Wilson et al. ..... 431/25

* cited by examiner

*Primary Examiner*—Pia Tibbits
(74) *Attorney, Agent, or Firm*—Leydig, Voit & Mayer, Ltd.

(57) ABSTRACT

A fault-tolerant multi-point flame sense circuit utilizes a single electronic switch to signal the presence or absence of flame to an electronic controller. Multiple flame sense electrodes may be input to this circuit. By configuring these electrodes in accordance with the present invention, cross-contamination of a single failed flame sense electrode will not affect the other flame sense electrodes' ability to sense a flame at their associated burner. The circuit provides inputs for a number of flame sense electrodes via input channels that are capacitively coupled to the line voltage and resistively coupled to an RC network that controls the state of an electronic switch. When a flame is present at any one of the electrodes, the resulting unbalance current flow through the RC network turns the switch off to indicate the presence of flame. This operation is not affected by a short on any other electrode in the circuit.

13 Claims, 3 Drawing Sheets

FAULT-TOLERANT MULTI-POINT FLAME SENSE CIRCUIT

FIELD OF THE INVENTION

This invention relates generally to burner flame sense circuitry, and more particularly to electronic flame sense circuitry having multiple flame sense electrodes for sensing multiple burners.

BACKGROUND OF THE INVENTION

Advances in the sophistication and reliability of control electronics have long made their incorporation in consumer appliances desirable. However, only recently has the cost of such electronics been compatible with the extremely competitive marketplace for these appliances.

One such commercial and consumer market into which control electronics have now been widely incorporated is that for consumer and commercial cooking appliances such as ovens. The control electronics for such modern ovens provide programmable cooking cycles and control each aspect of the flame control system, primarily safety control. Many such modern ovens incorporate a gas distribution system (GDS) that includes an ignition module, solenoid valves, burners, and hot surface igniter or spark electrodes. The ignition module dispenses with the necessity of continually having a pilot flame burning in the appliance to reliably ignite the gas burners when called for by the thermostat. The electronically controlled solenoid valve controls the gas flow for each cooking cycle, and allows for proper purging and gas shutoff during fault conditions. Such gas distribution systems typically include an electronic flame sense circuit to sense when the burners are ignited. This flame sense is used to control the direct spark ignition of the gas and to sense failure or flameout conditions. These conditions may necessitate reactivating an ignition sequence in an attempt to relight the burners or shutting off of the gas solenoid valve to allow for oven cavity purging before re-ignition is attempted. Electronic flame sense circuits typically rely on a physical phenomena of flame known as current rectification within a flame. According to this principle, a flame will conduct electricity in one direction. As such, the flame may be modeled as a resistor diode combination that allows current flow only in a single direction therethrough. These circuits are, of course, designed such that they are fail safe. That is, the typical failure mode of these circuits is such to indicate to the electronic controller that no flame is sensed. In this way, the electronic controller will shut off the gas solenoid valve to the oven burners.

In typical consumer ovens, at least two burner elements are included within the oven cavity. Typically, a bottom burner is used during bake cycles, while an upper burner is used to allow broiling. In such applications, a need exists for flame sensing of both the upper and lower burners. While separate flame sense circuits could be utilized, such would serve to simply increase the cost of the sensing circuitry required by a factor of two. Indeed, in applications where multiple burners are used, the provision of multiple flame sense circuits increases the cost of the circuitry accordingly.

Recognizing that the two-burner configuration in a consumer oven allows operations of only one burner at a time, i.e., either baking or broiling, a single dual flame sense circuit integrating two flame sensors has been developed as illustrated in FIG. 1. Under typical operating conditions, only one of the two flame sense electrodes 100, 102 would be required to sense flame at any given point in time based on the alternate controlled operation of the bake and broil burners. The flame-sensing portion of this circuit is powered from the line voltage L1 through a capacitor 104. Each flame sense electrode 100, 102 also includes a current limiting resistor 106, 108. A voltage divider network including resistor 110, and the RC combination of resistor 112 and capacitor 114 is also included. The midpoint between this resistor 110 and the RC combination 112, 114 is coupled through resistor 115 to the gate of a 116 of a junction field effect transistor (JFET) 118, whose drain is coupled through resistor 120 to a 5 volt DC input and whose source 122 is coupled to ground.

With no flame present at either burner being sensed by sensing electrodes 100, 102, operation of the flame sense circuit of FIG. 1 generates an output voltage level equal to the drain to source voltage which is sensed by the electronic controller (not shown) as a no flame condition. That is, current flow during the positive half cycle of source L1 flows through capacitor 104 resistor 110 and the RC network 112, 114. This generates a positive gate source voltage VDS. With such a positive voltage at gate 116, the JFET 118 remains in a conducting state allowing current flow therethrough. During the negative half cycle of source L1, current flows from ground through the RC network, 112, 114, through resistor 110 and capacitor 104 to the source L1. During this negative half cycle, the voltage developed at the gate 116 across the RC network 112, 114 is negative. This negative voltage, however, is not sufficient to pinch off the JFET 118 to halt current flow therethrough. As a result, the JFET 118 will remain on, and the controller will continue to sense a very small voltage $v_{DS}$.

If a flame is present at either burner as sensed by electrodes 100, 102, the flame sense circuit may be represented as illustrated in FIG. 2. As may be seen from an analysis of this FIG. 2, a flame may be represented as a series combination of a resistor 124 and a diode 126. As will be understood by those skilled in the art, the flame provides rectification whereby current flow is allowed only in a single direction therethrough. During this flame sense condition, current flow will be from source L1 through capacitor 104 to a current divider network comprised of resistor 106 and flame (resistor 124 and diode 126), and the voltage divider network of resistor 110 and RC network 112, 114. However, the resistor 106 is sized in relation to resistor 110 to allow a majority of the current flow from source L1 during this positive half cycle through its branch of the circuit.

During the negative half cycle, however, the rectification action of the flame prevents any reverse current flow through resistor 106 of the circuit. Instead, all of the current flow during the negative half cycle flows from ground through the RC network 112, 114 through resistor 110 and capacitor 104 to source L1. As a result of the unequal current flow through the RC network 112, 114 during the positive and negative half cycles of source L1, an accumulation of negative charge is developed across capacitor 114. This negative charge is coupled to gate 116 of JFET 118, which pinches off the JFET 118 halting current flow therethrough. Because this negative charge is not drained away during the positive half cycle, the JFET 118 remains in an off condition during the entire period of flame presence. This will be sensed as a constant 5 voltage level by the electronic controller, which will be read as a flame present condition. As soon as the flame (resistor 124 and diode 126) disappears, operation of the circuit will return to that illustrated and described above with reference to FIG. 1, allowing the JFET 118 to turn on and dropping the sensed voltage flow a high level (e.g. 5 v) to a low level (e.g. $V_{DS}$).

While the circuit of FIG. 1 provides a significant cost savings over the usage of two separate flame sense circuits, a passive failure at one of the flame sense electrodes may go undetected and result in a failure to sense flame when actually present. Such a condition is illustrated in FIG. 3. If one of the flame sense electrodes 102 is shorted 128 to ground, the circuit will no longer sense flame at either of the flame sense electrodes 100, 102. When neither the oven nor the broiler is turned on, the circuit appears to operate normally with the JFET 118 remaining in its conducting mode allowing current to flow therethrough. As a result, the presence of this short 128 will go undetected until one of the burners is turned on. FIG. 3 illustrates the effect when the burner associated with the other flame sense electrode 100 is turned on.

During the positive half cycle of source L1, current flows through capacitor 104 into a three-way current divider network having one branch through the unfaulted flame sense electrode 100, another branch through the faulted electrode 102 and short 128, and a third branch through the resistor 110, RC network 112, 114. During the negative half cycle of source L1, no current can flow through the sensed flame (resistor 124 diode 126) as discussed above. However, instead of forcing the current to flow through the RC network 112, 114 to develop a net negative charge across capacitor 114 thus pinching off JFET 118, reverse current is allowed to flow through the short 128. Due to the presence of this short 128, sufficient negative charge across capacitor 114 cannot develop at the gate 116 of JFET 118. As a result, the JFET 118 is allowed to remain in its conducting state, which is sensed by the electronic controller as a no-flame condition. As a result, the electronic controller will shut down the burner even though its flame sense electrode 100 is unfaulted.

This operation may be understood more clearly with reference to FIG. 4. In this FIG. 4, the flame sense circuit is redrawn to illustrate circuit operation during a negative half cycle of source L1. To simplify the description of this circuit, the flame sense electrode 100 is not shown because no current may flow in this branch during the negative half cycle due to the flame rectification. As may be seen more clearly from this redrawn circuit of FIG. 4, current during this negative half cycle will flow from ground through short 128, resistor 108, capacitor 104 to the source L1. Current will also flow from ground through the RC network 112, 114, resistor 110, and capacitor 104 during this negative half cycle. However, the proportion of current flowing through the short circuit 128 to that flowing through the RC network 112, 114 is such that the charge across capacitor 114 at gate 116 is not sufficient to shut off switch 118. As such, the JFET 118 is allowed to remain conducting, which is sensed as a no-flame condition.

As a result of this cross-contamination, field service personnel will have a difficult time isolating the failure. This is because the typical problem report will indicate that the burner with the unfaulted flame sense electrode 100 was turned on but the system did not sense a flame. However, examination of the flame sense electrode 100 will not reveal any failure because, in fact, this electrode is not faulted. The cross contamination of failures in this circuit tends to increase the field service time required to diagnose and correct the problem, thus increasing the cost of ownership of the appliance and leading to customer dissatisfaction. However, the cost of utilizing two separate flame sense circuits for each of the two burners is cost prohibitive from a manufacturing/marketability standpoint. Therefore, a need exists in the art for a new and improved multi-point flame sense circuit that does not suffer from the flame sense electrode failure cross contamination problem existing with the present circuit.

The invention provides such a circuit. These and other advantages of the invention, as well as additional inventive features, will be apparent from the description of the invention provided herein.

BRIEF SUMMARY OF THE INVENTION

In view of the above it is an objective the present invention to provide a new and improved multi-point flame-sense circuit. More particularly, it is an objective the present invention to provide a new and improved multi-point flame-sense circuit that does not suffer from the cross-contamination problem of the prior integrated multi-point flame sense circuit discussed above. Specifically, it is an objective of the present invention to provide a fault tolerant multi-point flame sense circuit that allows a number of flame-sense electrodes to be utilized to sense multiple burners or multiple locations on a burner to verify proper operation of the burner element. Preferably, a failure of any one of the multiple flame-sense electrodes will not disrupt the ability of the circuit to properly sense flame present at a non-faulted flame-sense electrode.

In one embodiment of the present invention, each individual flame-sense electrode is coupled to the multi-point fault-tolerant flame-sense circuitry of the present invention via a separate channel powered by the line voltage and coupled to the output switching device. Preferably, each channel provides a capacitive coupling to the source voltage, and a resistive coupling to the input-switching device. In a highly preferred embodiment, each of the channels for the multiple flame-sense electrodes are coupled in parallel with one another between these two points. A current limiting resistor is also included in association with each flame-sense electrode. The circuit elements are then balanced to ensure that proper operation of the sense circuit is not affected by failure of any one of the flame-sense electrodes.

In one embodiment of the present invention, a fault-tolerant multi-point flame sense circuit comprises an electronically controllable switch having a control input, an RC network having a first node coupled to the control input of the switch and a second node coupled to ground, and a number of flame sense electrode channels. Each flame sense electrode channel has a separate capacitive coupling to a line voltage input and a separate resistive coupling to the RC network. Preferably, each flame sense electrode channel includes a current limiting resistor that couples a flame sense electrode to a junction between the capacitive coupling to the line voltage input and the resistive coupling to the RC network. The flame sense electrode channels are preferably balanced with one another such that current flow between the line voltage input and the ground during both positive and negative half cycles of an external line voltage is equal when no flame is present at any of the flame sense electrodes. As such, the electronically controllable switch remains in a quiescent state when no flame is present at any of the flame sense electrodes.

In a further embodiment, each of the flame sense electrode channels for which its associated flame sense electrode is not failed provides a current flow path between the line voltage input and the first node of the RC network. As such, a transition of the electronically controllable switch from a quiescent state is precluded without a flame being present at one of the flame sense electrodes of one of the channels for which its associated flame sense electrode is not failed when one of the flame sense electrode channels includes a flame sense electrode that is failed. Preferably, current flow through the RC network is unbalanced during positive and negative half cycles of the external line voltage when one of the flame sense electrode channels for which its associated flame sense electrode is not failed senses a flame. This results in a net voltage buildup across the RC network and transitions the electronically controllable switch from the quiescent state. In one embodiment, the flame sense electrode channels are balanced with one another such that current flow between the line voltage input and the ground during negative half cycles of an external line voltage is equal when flame is present at any of the flame sense electrodes. This results in a negative charge developing across the RC network. As a result, the electronically controllable switch changes from a quiescent state when flame is present at any of the flame sense electrodes.

In an alternate embodiment of the present invention, a fault-tolerant multi-point flame sense circuit comprises a line voltage input adapted to receive AC line voltage from an external source, an electronically controllable switch, a switch control circuit coupled to the electronically controllable switch, and a number of parallel flame sense channels. Each flame sense channel is coupled between the switch control circuit and the line voltage input. Preferably, each flame sense channel comprises a flame sense electrode in series with a current limiting resistor that is coupled to a first capacitor, which is coupled to the line voltage input. The current limiting resistor further is coupled to a first resistor, which is coupled to the switch control circuit.

In a further embodiment, the switch control circuit comprises a second resistor and a second capacitor coupled in parallel to ground. Preferably, the number of parallel flame sense channels comprises two parallel flame sense channels. Current flow through the parallel flame sense channels ensures that the switch control circuit transitions the electronically controllable switch when one of the flame sense channels senses a flame. In this embodiment, when at least one of the parallel flame sense channels includes a flame sense electrode that is shorted to ground, current flow through the other parallel flame sense channels ensures that the switch control circuit transitions the electronically controllable switch when one of the other flame sense channels senses a flame. The current flow through the other parallel flame sense channels ensures that the switch control circuit does not transition the electronically controllable switch when no one of the other flame sense channels senses a flame.

In yet a further embodiment of the present invention, a flame sense circuit comprises a first flame sense electrode coupled through a first resistor to a first node. This first node couples a first capacitor and a second resistor, the first capacitor being coupled to a line voltage input and the second resistor being coupled to a flame sense input node. The flame sense input node is coupled to a third resistor that is coupled to a gate of a junction field effect transistor. The drain of the JFET is coupled through a resistor to a control voltage input, and its source is coupled to ground. The flame sense input node further is coupled to a fourth resistor and to a second capacitor, both of which are also coupled to ground. The circuit further includes a second flame sense electrode coupled through a sixth resistor to a second node coupling a third capacitor and a seventh resistor. The third capacitor is coupled to the line voltage input and the seventh resistor is coupled to the flame sense input node.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 5:
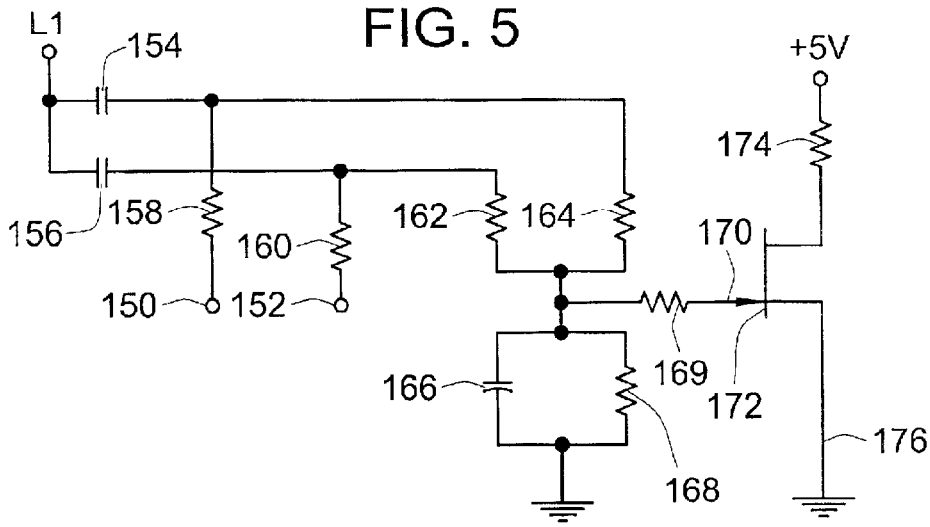
FIG. 5 is a simplified circuit diagram of an embodiment of the fault-tolerant multi-point flame sense circuit of the present invention.

To avoid the cross-contamination failure problem of the prior multi-point flame sense circuit without increasing the cost significantly over the prior circuit, the circuit of FIG. 5 was developed. As will be described below, this circuit is immune from cross-contamination of a failure of one of the flame sense electrodes. That is, while a failure of a flame sense electrode for a particular burner will not allow that burner to operate, other burners within the system whose flame sense electrodes are not failed will be able to continue to operate properly. That is, their flame sense electrodes will continue to properly sense flame when present so that the electronic controller will operate those burners and their associated spark electrodes and gas solenoids correctly. This circuit will also greatly reduce the amount of time required to diagnose and repair a failure of one of the flame sense electrodes since the failure will be detected when the burner associated with that failed electrode is operated. In this way the field personnel will be able to immediately inspect the electrode of the suspect burner with confidence that a latent failure located elsewhere in the system could not have caused the field problem. This greatly reduces the amount of time required for the service personnel, especially considering that the burners and their associated flame sense electrodes are physically located in different areas of the oven compartment. This reduces the overall cost of ownership and increases the customer satisfaction.

Figure 1:
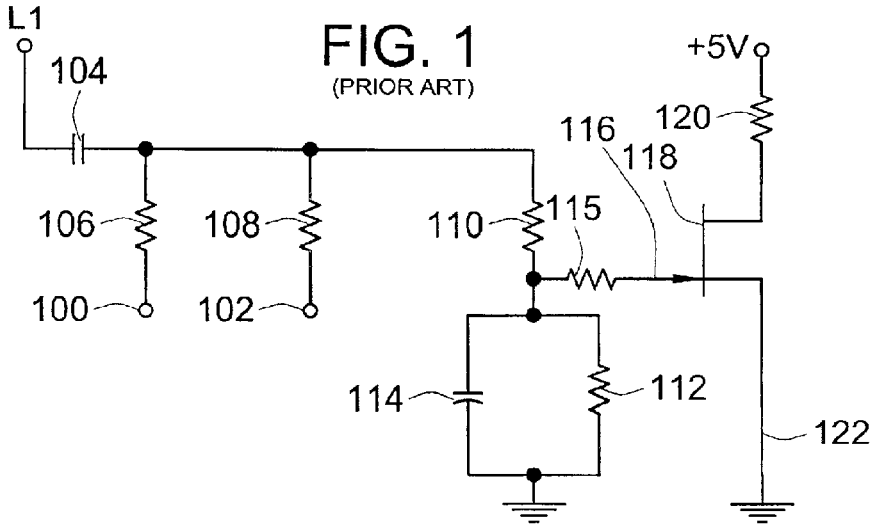
FIG. 1 (PRIOR ART)
FIG. 1 is a simplified circuit diagram of a prior multi-point flame sense circuit.
Figure 2:
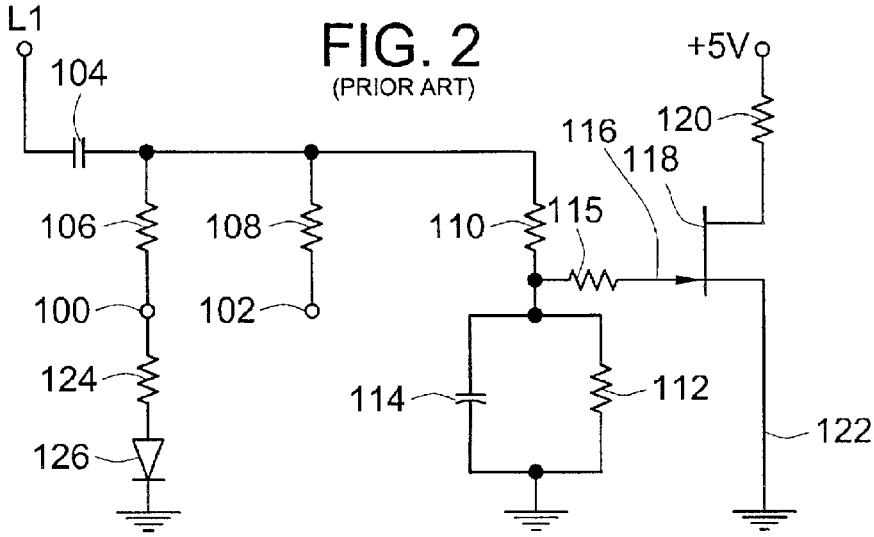
FIG. 2 (PRIOR ART)
FIG. 2 is a simplified circuit diagram of the circuit of FIG. 1 modeling the sensing of a flame.
Figure 3:
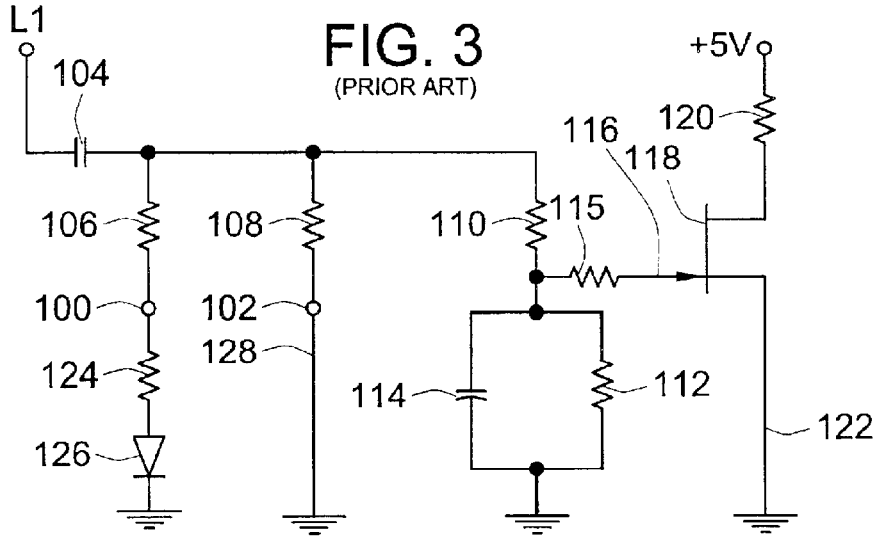
FIG. 3 (PRIOR ART)
FIG. 3 is a simplified circuit diagram of the circuit of FIG. 1 modeling the sensing of a flame and a failed flame sense electrode.

Turning now to the fault-resistant multi-point flame sense circuit of the present invention illustrated in FIG. 5, it can be seen that, from a total part count point of view, this fault tolerant circuit adds only two passive components to the number of parts required by the flame circuit of FIG. 1, which is subject to the cross-contamination failure problem. As such, its slight increase in cost over the prior circuit is far out weighed by the reduce service time and increased overall reliability provided by this circuit. It should be noted that while this circuit of FIG. 5 illustrates the usage of only two flame sense electrodes 150, 152, one skilled in the art will recognize that multiple flame sense electrodes may be included in this circuit as required by the particular installation into which it is to be used with appropriate balancing of component values.

In this improved circuit of FIG. 5, the line input L1 is coupled to each of the flame sense electrodes 150, 152 through different channels. The channel for flame electrode 150 utilizes capacitor 154, resistor 158, and is coupled through resistor 169 to the gate 170 of JFET 172 through resistor 164. For flame sense electrode 152, the channel includes capacitor 156, resistor 160, and is coupled through resistor 169 to the gate 170 of JFET 172 through resistor 162. This resistor 169 is also coupled to an RC network (including capacitor 166 and resistor 168) to ground. The source 176 of JFET 172 is also coupled to ground, and the drain is coupled through resistor 174 to a 5 volt supply. As may be apparent from this description, additional flame sense electrodes may be added to this circuit by providing a capacitive coupling to source L1 and a resistive coupling to the resistor 169 and the gate 170 of JFET 172.

As may also be apparent from this FIG. 5, operation of this circuit with no flame present at any of these sensed burners results in JFET 172 remaining in its conducting state allowing current to flow therethrough. That is, the forward and reverse current flow during each of the positive and negative half cycles of source L1 flows equally through capacitors 154 and 156 and resistors 162 and 164 to the node coupled to the resistor 169 and gate 170, and through the RC network 168, 166 to ground. As a result of this equal forward and reverse current flow, a sufficient negative charge cannot develop across capacitor 166 to pinch off JFET 172. As a result, the JFET 172 remains conducting and the electronic controller (not shown) senses a flame off or no-flame condition.

Figure 6:
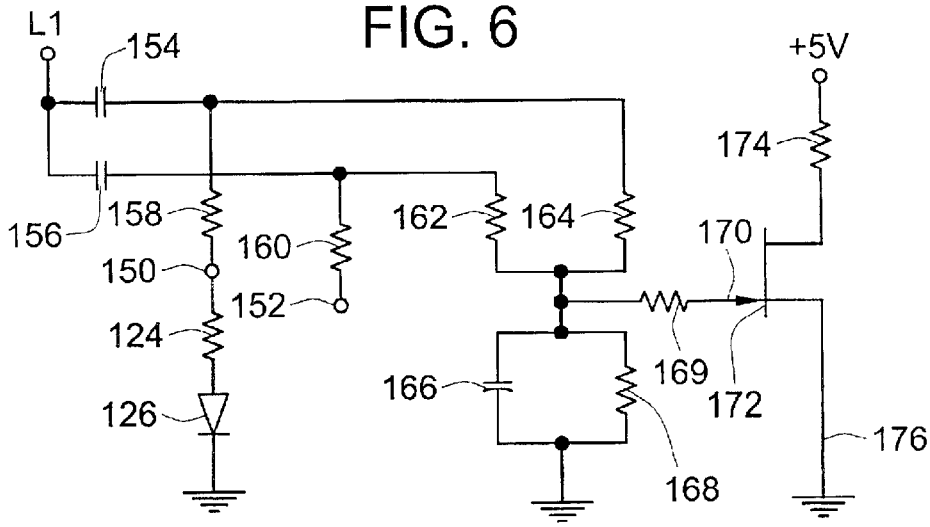
FIG. 6 is a simplified circuit diagram of the circuit of FIG. 5 modeling the sensing of a flame.

During a normal flame sense condition, the flame sense circuit of the present invention may be represented as illustrated in FIG. 6. In this FIG. 6, the flame is represented as resistor 124 and diode 126 coupling the flame sense electrode 150 to ground. Current flow during the positive cycle of source L1 will flow primarily through the resistor 158, flame sense electrode 150, and flame (represented by resistor 124 and diode 126) to ground. While positive current will also flow through the RC network 166, 168, this current will be small as a result of the relative sizing of resistor 158 and 164. During the negative half cycle of source L1, current flow through flame sense electrode 150 is precluded by the rectification effect of the flame sensed thereby. As a result, all of the reverse current flow during the negative half cycle of source L1 is forced to flow through the RC network 166, 168 and is then divided equally between the paths including resistor 162 and capacitor 156 and the path including resistor 164 and capacitor 154 to source L1. Since the proportion of current flow through RC network 166, 168 during the negative half cycle is much greater than that flowing in the opposite direction during the positive half cycle, a net negative charge develops across capacitor 166. This net negative charge is applied to gate 170 of JFET 172, which pinches off the JFET 172 halting current flow therethrough. The electronic controller then senses that the JFET 172 has turned off, and processes this information as a flame present condition.

Figure 7:
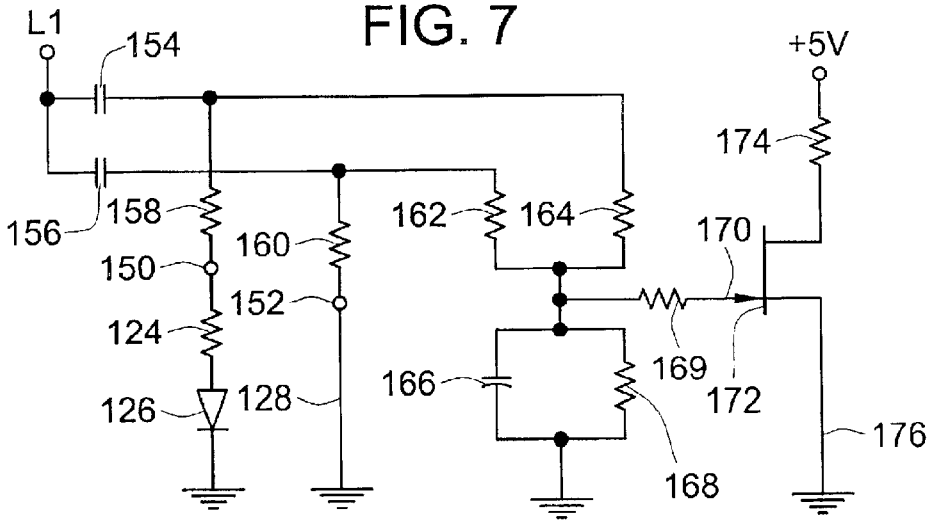
FIG. 7 is a simplified circuit diagram of the circuit of FIG. 5 modeling the sensing of a flame and a failed flame sense electrode.

If a latent failure exists with one of the other flame sense electrodes as illustrated by the circuit of FIG. 7 as a short 128 from the flame sense electrode 152 to ground, the ability of the other flame sense electrodes to properly sense the presence of flame at their associated burners is not affected. Of course, the faulted flame sense electrode 152 will not be able to sense the presence of flame as a result of the short 128. As a result, the electronic controller will not allow that associated burner to operate for safety reasons, and will properly log a failure with regard to that burner.

Operation of this circuit with a flame sensed at flame sense electrode 150 and with a failure 128 on an unassociated flame sense electrode 152 during the positive half cycle of source L1 proceeds in much the same way as the unfaulted circuit in FIG. 6. That is, only a very small portion of the current from source L1 is allowed to flow through the RC network 166, 168 during this positive half cycle. The majority of the current during this positive half cycle flows instead through the two flame sense electrode branches. While more of the current flows through the faulted flame sense electrode 152 due to the short 128, as opposed to the presence of the flame represented by resistor 124 and diode 126, the effect from the standpoint of the RC network is nearly the same, i.e. not much positive current flows therethrough during the positive half cycle.

Operation of the fault-tolerant multi-point flame sense circuit of the present invention during the negative half cycle of source L1 with a failure of an unassociated flame sense electrode 152 varies significantly from the prior multi-point flame sense circuit discussed above. Specifically, while current is allowed to flow through the short circuit 128 of flame electrode 152 during the negative half cycle of source L1, a net negative charge across capacitor 166 is still generated sufficient to pinch off the current flow through JFET 172. This allows the electronic controller to sense a flame condition at flame sense electrode 150.

Figure 4:
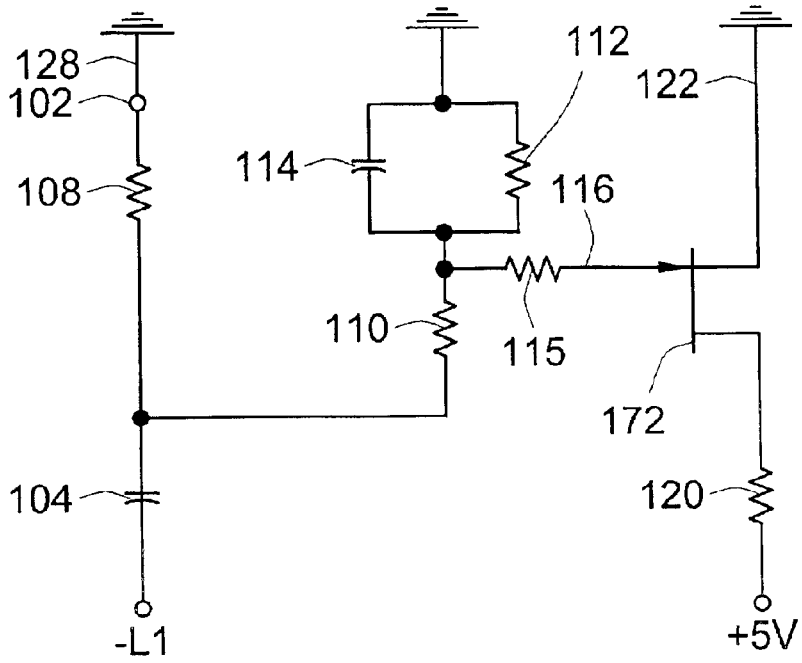
FIG. 4 (PRIOR ART)
FIG. 4 is a redrawn simplified circuit diagram of the circuit of FIG. 3.
Figure 8:
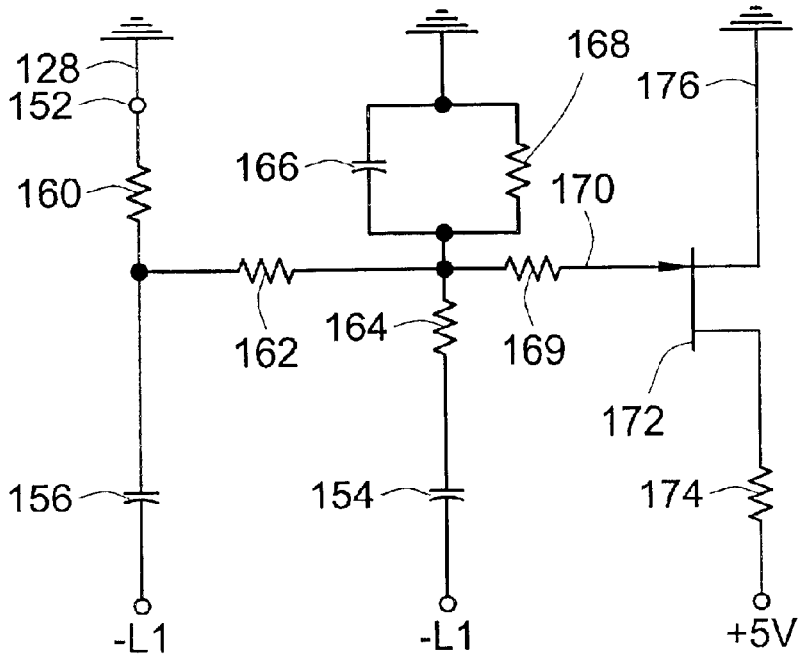
FIG. 8 is a redrawn simplified circuit diagram of the circuit of FIG. 7.

During this negative half cycle of source L1, the circuit of FIG. 7 may be redrawn as illustrated in FIG. 8 to simplify the understanding of the operation of this circuit. During the negative half cycle of source L1, the current will flow from ground through the short 128 of flame sense electrode 152 and its associated resistor 160 through capacitor 156 to source L1. Current will also flow from ground through the RC network 166, 168 through resistor 162 and capacitor 156 to L1. However, current is also allowed to flow through the channel associated with the flame sense electrode 150, that is through resistor 164 and capacitor 154 to source L1. As may be seen from a comparison of this FIG. 8 with the prior circuit illustrated in FIG. 4, the addition of the extra channel for current flow during the negative half cycle (resistor 164, capacitor 154) allows a sufficient negative charge to be developed across capacitor 166 as coupled to gate 170 so that the JFET 172 may still be pinched off, halting current flow therethrough. The electronic controller (not shown) will detect this as a flame present condition, which is proper because of the flame present at flame sense electrode 150. If no flame were present at this flame sense electrode 150, there would not be the unbalance current flow through the RC network 166, 168 that will result in a net negative charge being developed across capacitor 166 sufficient to pinch off JFET 172. Only when the flame is present and current is allowed to flow through the associated unfaulted flame sense electrode 150 does this current flow unbalance result in the development of a charge sufficient to pinch off the switch 172.

In one embodiment of the present invention, the circuit is balanced as follows: capacitors 154 and 156 are 0.01 microfarads, resisters 158 and 160 are 1.0 megaohms, resistors 162, 164, and 169 are 4.7 megaohms, resistor 168 is 22 megaohms, and capacitor 166 is 0.1 microfarads. Preferably, the ratios of resistor 158 to resistor 162, and of resistor 160 to resistor 164 are equal and a minimum of ¼ to 1.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fault-tolerant multi-point flame sense circuit, comprising:

an electronically controllable switch having a control input, an RC network having a first node coupled to the control input of the switch and a second node coupled to ground; and a plurality of flame sense electrode channels, each flame sense electrode channel having a separate capacitive coupling to a line voltage input and a separate resistive coupling to the first node of the RC network.

2. The circuit of claim 1, wherein each flame sense electrode channel further includes a current limiting resistor coupling a flame sense electrode to a junction between the capacitive coupling to the line voltage input and the resistive coupling to the first node of the RC network.

3. A fault-tolerant multi-point flame sense circuit, comprising:

an electronically controllable switch having a control input, an RC network having a first node coupled to the control input of the switch and a second node coupled to ground;

a plurality of flame sense electrode channels, each flame sense electrode channel having a separate capacitive coupling to a line voltage input and a separate resistive coupling to the first node of the RC network;

wherein each flame sense electrode channel further includes a current limiting resistor coupling a flame sense electrode to a junction between the capacitive coupling to the line voltage input and the resistive coupling to the first node of the RC network; and wherein the flame sense electrode channels are balanced with one another such that current flow between the line voltage input and the ground during both positive and negative half cycles of an external line voltage applied thereto is equal when no flame is present at any of the flame sense electrodes, and wherein the electronically controllable switch remains in a quiescent state when no flame is present at any of the flame sense electrodes.

4. The circuit of claim 3, wherein each of the flame sense electrode channels for which its associated flame sense electrode is not failed provides a current flow path between the line voltage input and the first node of the RC network such that a transition of the electronically controllable switch from a quiescent state is precluded without a flame being present at one of the flame sense electrodes of one of the flame sense electrode channels for which its associated flame sense electrode is not failed when one of the flame sense electrode channels includes a flame sense electrode that is failed.

5. The circuit of claim 4, wherein current flow through the RC network is unbalanced during positive and negative half cycles of the external line voltage when one of the flame sense electrode channels for which its associated flame sense electrode is not failed has flame present, thereby resulting in a net voltage buildup across the RC network and transition of the electronically controllable switch from the quiescent state.

6. A fault-tolerant multi-point flame sense circuit, comprising:

an electronically controllable switch having a control input, an RC network having a first node coupled to the control input of the switch and a second node coupled to ground; and a plurality of flame sense electrode channels, each flame sense electrode channel having a separate capacitive coupling to a line voltage input and a separate resistive coupling to the first node of the RC network;

wherein each flame sense electrode channel further includes a current limiting resistor coupling a flame sense electrode to a junction between the capacitive coupling to the line voltage input and the resistive coupling to the first node of the RC network; and wherein the flame sense electrode channels are balanced with one another such that current flow between the line voltage input and the ground during negative half cycles of an external line voltage applied thereto is equal when flame is present at any of the flame sense electrodes resulting in a negative charge developing across the RC network, and wherein the electronically controllable switch changes from a quiescent state when flame is present at any of the flame sense electrodes.

7. A fault-tolerant multi-point flame sense circuit, comprising:

a line voltage input adapted to receive AC line voltage from an external source;

an electronically controllable switch;

a switch control circuit coupled to the electronically controllable switch;

a plurality of parallel flame sense channels, each flame sense channel being coupled between the switch control circuit and the line voltage input.

8. The circuit of claim 7, wherein each flame sense channel comprises a flame sense electrode in series with a current limiting resistor that is coupled to a first capacitor, which is coupled to the line voltage input, the current limiting resistor further being coupled to a first resistor, which is coupled to the switch control circuit.

9. The circuit of claim 8, wherein the switch control circuit comprises a second resistor and a second capacitor coupled in parallel to ground.

10. The circuit of claim 7, wherein the plurality of parallel flame sense channels comprises two parallel flame sense channels.

11. The circuit of claim 7, wherein current flow through the parallel flame sense channels ensures that the switch control circuit transitions the electronically controllable switch when one of the flame sense channels senses a flame.

12. The circuit of claim 11, wherein at least one of the parallel flame sense channels includes a flame sense electrode that is shorted to ground, and wherein current flow through the other parallel flame sense channels ensures that the switch control circuit transitions the electronically controllable switch when one of the other flame sense channels senses a flame, and wherein current flow through the other parallel flame sense channels ensures that the switch control circuit does not transition the electronically controllable switch when no one of the other flame sense channels senses a flame.

13. A flame sense circuit, comprising a first flame sense electrode coupled through a first resistor to a first node coupling a first capacitor and a second resistor, the first capacitor being coupled to a line voltage input and the second resistor being coupled to a flame sense input node, the flame sense input node being coupled to a third resistor that is coupled to a gate of a junction field effect transistor, a drain of which is coupled through a resistor to a control voltage input and a source of which is coupled to ground, the flame sense input node further being coupled to a fourth resistor and to a second capacitor, both of which are also coupled to ground, and a second flame sense electrode coupled through a sixth resistor to a second node coupling a third capacitor and a seventh resistor, the third capacitor being coupled to the line voltage input and the seventh resistor being couple to the flame sense input node.

* * * * *